United States Patent [19]

Stonoga et al.

[11] 4,203,516

[45] May 20, 1980

[54] GREETING CARD

[75] Inventors: Dorothea E. Stonoga, Norwood; Virginia K. Flint-Smith, Waltham, both of Mass.

[73] Assignee: A. Bristol Corporation, Boston, Mass.

[21] Appl. No.: 11,076

[22] Filed: Feb. 12, 1979

[51] Int. Cl.[2] ..... B65D 85/72; B65D 81/04

[52] U.S. Cl. ..... 206/216; 206/472; 229/92.8; 426/104

[58] Field of Search ..... 206/216, 214, 472; 229/92.8; D1/27; 426/104

[56] References Cited

U.S. PATENT DOCUMENTS

| | | | |
|---|---|---|---|
| 982,711 | 1/1911 | Ellis | 426/104 |
| 3,261,456 | 7/1966 | Sparks | 206/523 |
| 3,307,281 | 3/1967 | Mateo | 229/92.8 |
| 3,677,399 | 7/1972 | Tatar | 229/92.8 |

*Primary Examiner*—William T. Dixson, Jr.

*Attorney, Agent, or Firm*—Wolf, Greenfield & Sacks

[57] ABSTRACT

A novelty greeting card having front and rear panels hingedly connected by a spine section of finite width. A block having a thickness equal to the width of the spine and the same area as the back panel is secured to the front face of the back panel. A well formed in the central portion of the block and contains a dog biscuit.

3 Claims, 3 Drawing Figures

FIG. 1
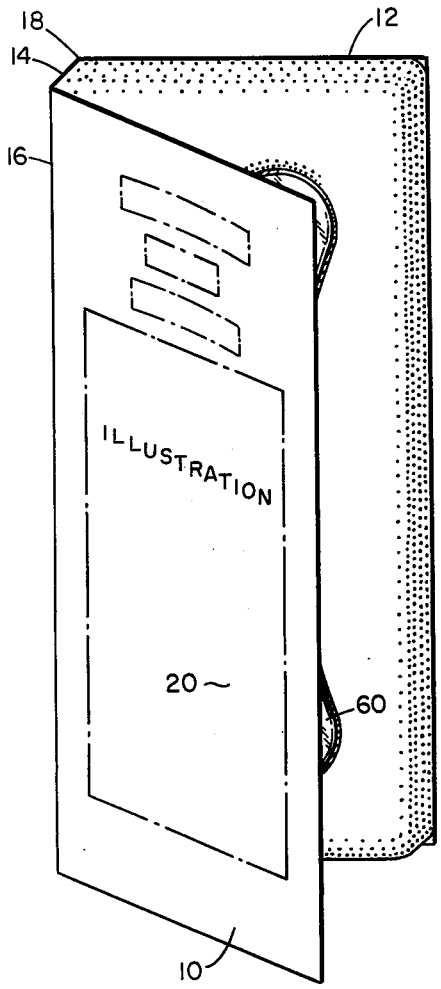
FIG. 2
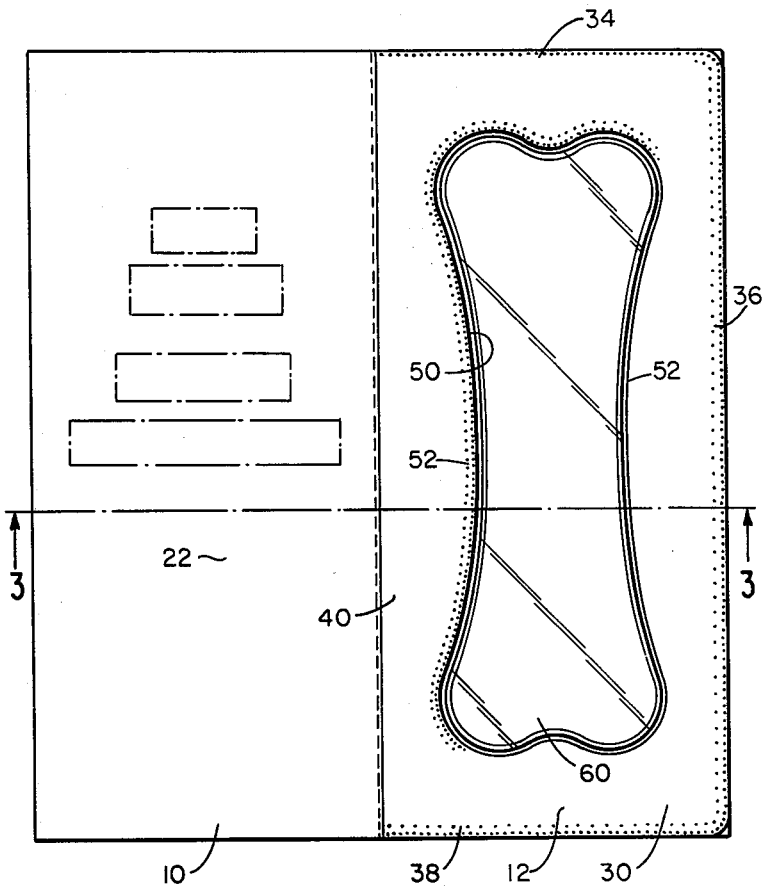
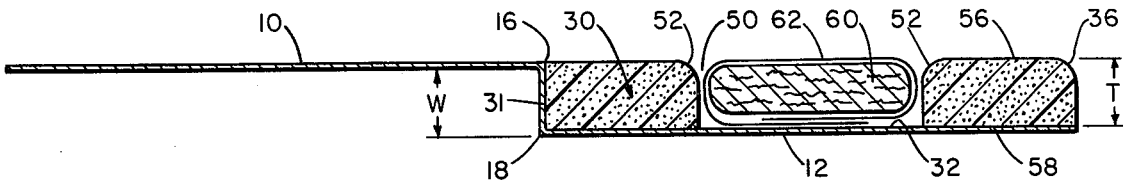
FIG. 3

GREETING CARD

INTRODUCTION

This invention relates to greeting cards and more particularly comprises a novelty greeting card directed to pet owners.

One important object of this invention is to provide a novelty greeting card that has particular appeal to pet owners.

Another and more specific object of this invention is to provide a greeting card having a protective pocket rendering it capable of incorporating into the card some form of pet food such as a dog biscuit.

Another object of this invention is to provide a greeting card capable of carrying a frangible food item such as a biscuit and which affords the food sufficient protection so that it may be sent through the mail without crumbling or otherwise being mutilated.

To accomplish these and other objects, the greeting card of this invention is composed of front and back panels connected together by a relatively wide spine. A block made of light-weight but rigid material having a thickness essentially equal to the width of the spine is secured to the front face of the rear panel so that it lies between the two panels when the card is closed. A well is provided in the block sized to conform in shape to the shape of the pet food to be packaged in the card so that the food is received snugly in the well. A film wrap is provided over the food to protect it, increase its shelf life, and retain it in the well.

These and other objects and features of this invention will be better understood and appreciated from the following detailed description of one embodiment thereof, selected for purposes of illustration and shown in the accompanying drawings.

BRIEF FIGURE DESCRIPTION

FIG. 1 is a perspective view of a pet greeting card in partially open position, made in accordance with this invention;

FIG. 2 is a plan view of the card in the open position; and

FIG. 3 is a cross sectional view taken along the corresponding section line 3—3 of FIG. 2.

DETAILED DESCRIPTION

The greeting card shown in FIG. 1 is composed of a pair of panels 10 and 12 integrally connected by a spine section 14 together cut from a heavy paper or cardboard like material. The top and bottom edges 16 and 18 of the spine section 14 join the adjacent edges of the front and back panels 10 and 12 to form hinge connections for the panels so that the card may be opened and closed as the covers of a book.

As in conventional greeting cards, the front face 20 of front panel 10 may carry a greeting and/or picture or any other indicia desired. Similarly, the rear face 22 of the front panel pin may carry a message, picture, or other indicia.

A block 30 made of an inexpensive foam plastic material such as styrene is of substantially the same plan dimensions as the front and rear panels 10 and 12, and in the preferred form of this invention, the block 30 is secured to the front face 32 of rear panel 12 in the manner shown in the drawing. Any form of suitable adhesive material may be used to secure the block 30 in place. Block 30 has a thickness T which is substantially equal to or slightly less than the width W of spine 14 so that the block does not in any way interfere with the opening and closing of the front panel. Particularly, the thickness of the block 30 should not exceed the width of the spine 14 so that the front and rear panels may sandwich the block neatly without disturbing or in any way mutilating the hinge connections along the edges 16 and 18 of the spine. The side 31 of the block in the preferred form of the invention is cemented to the inner surface of the spine 14 so that only edge 16 of the spine serves as an active hinge.

The top edges 34, 36 and 38 of block 30 are provided with a small radius to give the block a finished appearance and reduce the likelihood of the edges becoming marred through handling. The edge 40 of the block 30 may also be provided with a radius although it is not so important as that edge is generally protected by the spine 14 of the card. In FIG. 3 edge 40 is in fact shown to be squared, which may provide superior support for hinge 16.

A well 50 is provided in the central portion of block 30 and in the preferred form of this invention the well extends completely through the block. As shown, the plan shape of the well 50 is that of a bone, a frequently used shape for dog biscuits. And in the preferred form of this invention, at least the upper edge 52 of the well 50 about its entire periphery is provided with a radius so it also is resistant to marring.

A biscuit 60 is shown in FIGS. 2 and 3 disposed in the well 50, and the biscuit substantially fills the entire well. The depth of well 50 is at least equal to or slightly exceeds the thickness of the biscuit 60 so that when the biscuit is placed in the well, it is protected within the planes of the upper and lower surfaces 56 and 58 of the block 30. The biscuit 60 may be prewrapped, that is, completely enclosed in a film sheet as suggested by sheet 62 in FIG. 3, or it may be sealed in the well by a film which covers the well and is secured to the block 30. Either of these forms of wrapping for the biscuit may be employed. It will of course be appreciated that if the pet food item contained in the well is itself protected by some form of packaging, it is not necessary to enclose the well by providing a cover sheet over the block. On the otherhand, such a sheet may be used as dress for the card to provide it with a more elegant appearance.

Because the foam block 30 is substantially the same size as panels 10 and 12, the edges of the panels 10 and 12 will not be particularly susceptible to bending or marring when the card is shipped. Rather, the block itself will provide a firm support for the panels. It will also be appreciated that because the pet food items such as the biscuit shown in the drawing is completely confined within the well 50 and is held firmly in it so that it will not slide or move around during handling, the biscuit will be protected from being crushed. The food particularly if individually wrapped may be cemented in the well to insure that it will not accidentally dislodge from it. The rigidity of the block 30 will prevent the card from collapsing the well even when substantial weight is applied. It will also be recognized that because the block 30 is made of extremely light material such a styrene foam having a very low density, the card will not be expensive to mail. The card along with its contents essentially forms a uniform block which is a very convenient size for packing.

It will be apprieciated that a very wide latitude of pet-foodtype items can be packaged in the card of this invention and that such a card can be directed to and be appropriate for pet owners of a very wide variety of pets. Moreover, the item packaged in the card may not be a food item at all, but rather may be a pet toy or other such related item.

Because modifications may be made of this invention without departing from its spirit, it is not intended that the invention be limited to the specific embodiment illustrated and described. Rather, the invention is to be limited by the appended claims and their equivalents.

We claim:

1. A greeting card comprising:

a pair of panels integrally formed with a spine section of finite width, said panels being of the same size and forming front and back panels each hingedly joined to the spine along opposite edges thereof, a relatively rigid protective block having top, bottom and side surfaces and made of a foam material substantially equal in thickness to the width of the spine section and having width and height dimensions substantially equal to the dimensions of the panels, the bottom surface of said block being secured to the front face of the back panel so as to lie between the panels when the panels are closed, and one side surface being secured to the inner face of the spine so that only the hinge joining the front panel to the spine functions as a live hinge, a well provided in the block extending from the front face thereof, a pet product in the well and covered by a wrapper, the plan view of the well conforming in shape to the shape of the product so that the product is held snugly in the well, and message bearing indicia relating to the pet for whom the product is designed provided on the front of the front panel.

2. A greeting card as defined in claim 1 further characterized by the pet product being a food biscuit for pets.

3. A greeting card as defined in claim 1 further characterized by the edges on the upper surface of the block at the periphery of the block and well being rounded to resist marring.

* * * * *